US008353087B2

(12) United States Patent
Chen

(10) Patent No.: US 8,353,087 B2
(45) Date of Patent: Jan. 15, 2013

(54) CLOSURE DEVICE

(76) Inventor: Chin-Chu Chen, Taichung (TW)

( * ) Notice: Subject to any disclaimer, the term of this patent is extended or adjusted under 35 U.S.C. 154(b) by 186 days.

(21) Appl. No.: 13/041,436

(22) Filed: Mar. 7, 2011

(65) Prior Publication Data

US 2012/0228419 A1 Sep. 13, 2012

(51) Int. Cl.
*A43C 11/00* (2006.01)

(52) U.S. Cl. ..... 24/68 SK

(58) Field of Classification Search ..... 24/68 SK, 24/68 R, 68 B, 68 E, 71.1, 909; 36/50.1, 36/50.5; 242/388, 388.3, 395
See application file for complete search history.

(56) References Cited

U.S. PATENT DOCUMENTS 4,433,456 A * 2/1984 Baggio ..... 24/68 SK
7,367,522 B2 * 5/2008 Chen ..... 242/378.1
2006/0156517 A1 * 7/2006 Hammerslag et al. ..... 24/68 SK

* cited by examiner

*Primary Examiner* — James Brittain

(57) ABSTRACT

A closure device includes a knob. A ratchet member is mounted on a bottom of the knob. An engaging member is movably received in a cavity of the ratchet member. A spool is mounted on a bottom of the engaging member. A stopper is mounted around the spool. A base is proved for receiving the stopper, the spool, the engaging member, and the ratchet member.

7 Claims, 7 Drawing Sheets

CLOSURE DEVICE

BACKGROUND OF THE INVENTION

1. Field of the Invention

The present invention relates to a closure device, and more particularly to a closure device which utilizes a knob rotated toward in a first direction for engaging a spool to wind a lace around the spool and rotated toward in a second direction for releasing the spool to unwind the lace from the spool.

2. Description of Related Art

A conventional lace closure deice includes a housing, a spool, a ring and a knob. The spool is received in the housing and the ring is disposed on the spool for positioning the spool. The knob has an axle extending from a bottom thereof The knob has a driving gear annularly formed on an inner of the bottom thereof and a ratchet teeth annularly formed on an outer of the bottom thereof The driving gear and the ratchet teeth are concentrically arranged. The spool has a rotation gear upwardly extending therefrom. The axle of the knob passes through the ring and the spool. A stopping set is disposed in an inner periphery of the housing. The stopping set engages with the ratchet teeth. When the knob is pressed, the driving gear engages with the rotation gear of the spool and the ratchet teeth engaged with the stopping set such that the knob drives the spool for winding a lace around the spool. When the knob is upwardly pulled, the knob disengages from the spool and the stopping set for releasing the spool.

The conventional closure device utilizes the knob disengaging from the spool for releasing the spool. However, the connection between the knob and the spool is easily consumed after repeatedly usage in a period of time. Especially, the conventional closure device is utilized on snow boots and bicycle shoes, the unstable connection between the knob and the spool causes danger for a user.

The present invention has arisen to mitigate and/or obviate the disadvantages of the conventional tie-able securing warning light device.

SUMMARY OF THE INVENTION

The main objective of the present invention is to provide an improved closure device.

To achieve the objective, a closure device in accordance with the present invention comprises a knob. The knob has a spindle extending from a bottom thereof The spindle has a thread positioned therearound. The knob has at least one curved groove defined in the bottom thereof and located adjacent to the spindle. The spindle has a spindle hole axially defined therein. The knob has a plurality of the notches defined on an outer periphery thereof for increasing friction. A ratchet member is mounted on the bottom of the knob. The ratchet member has at least one rib disposed thereon for being correspondingly received in the at least one curved groove. The ratchet member has a cavity defined therein and passing therethrough. The cavity has a polygonal shape. The ratchet member has a series of ratchet teeth formed on a bottom thereof and located around the cavity. The cavity has at least one tenon extending from an inner periphery thereof An engaging member is movably received in the cavity. The engaging member has a polygonal shape corresponding to that of the cavity such that the engaging member is restricted in the cavity. The engaging member has at least one mortise defined in an outer periphery thereof for restricting the engaging member in the cavity and preventing the engaging member rotating relative to the cavity. The engaging member has an engaging hole defined therein and passing therethrough.

The engaging hole has at least one protrusion inwardly extending from an inner periphery thereof for engaging with the thread of the spindle. The engaging member has an engaging gear formed on a bottom thereof and annularly located around the engaging hole. A spool is mounted on a bottom of the engaging member. The spool has a spool gear annularly formed on a top thereof for corresponding to the engaging gear. The spool gear has a spool hole defined therein and passing therethrough. A stopper is mounted around the spool. The stopper has at least one tooth formed on a top thereof for unidirectionally engaging with the ratchet teeth of the ratchet member. The stopper has at least one rod downwardly extending from a bottom thereof Each of the at least one rod has a spring sleeved thereon. The stopper is able sink downwardly due to the compression of the spring. A base has a pivot extending therefrom. The pivot is freely rotatable. The pivot passes through the spool hole, the engaging hole, and the cavity and fixed in the spindle hole in the knob such that the spindle and the pivot are simultaneously rotated. The base has a skirt upwardly extending therefrom. The spool, the stopper, and the engaging member are received in the skirt. The knob and the ratchet member are mounted above the skirt.

Further benefits and advantages of the present invention will become apparent after a careful reading of the detailed description with appropriate reference to the accompanying drawings.

DETAILED DESCRIPTION OF THE INVENTION

Figure 1:
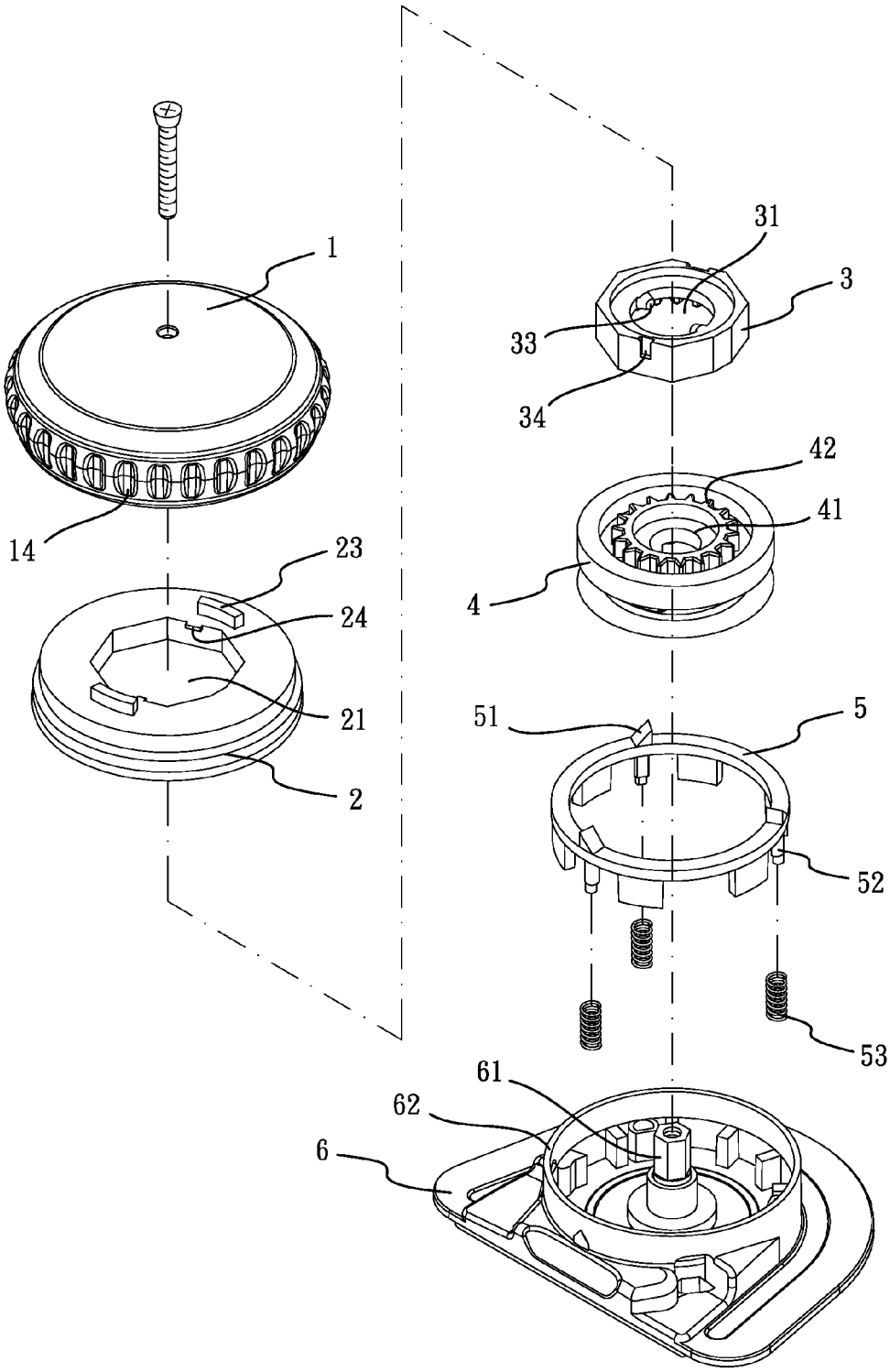
FIG. 1 is an exploded perspective view of a closure device in accordance with the present invention.
Figure 2:
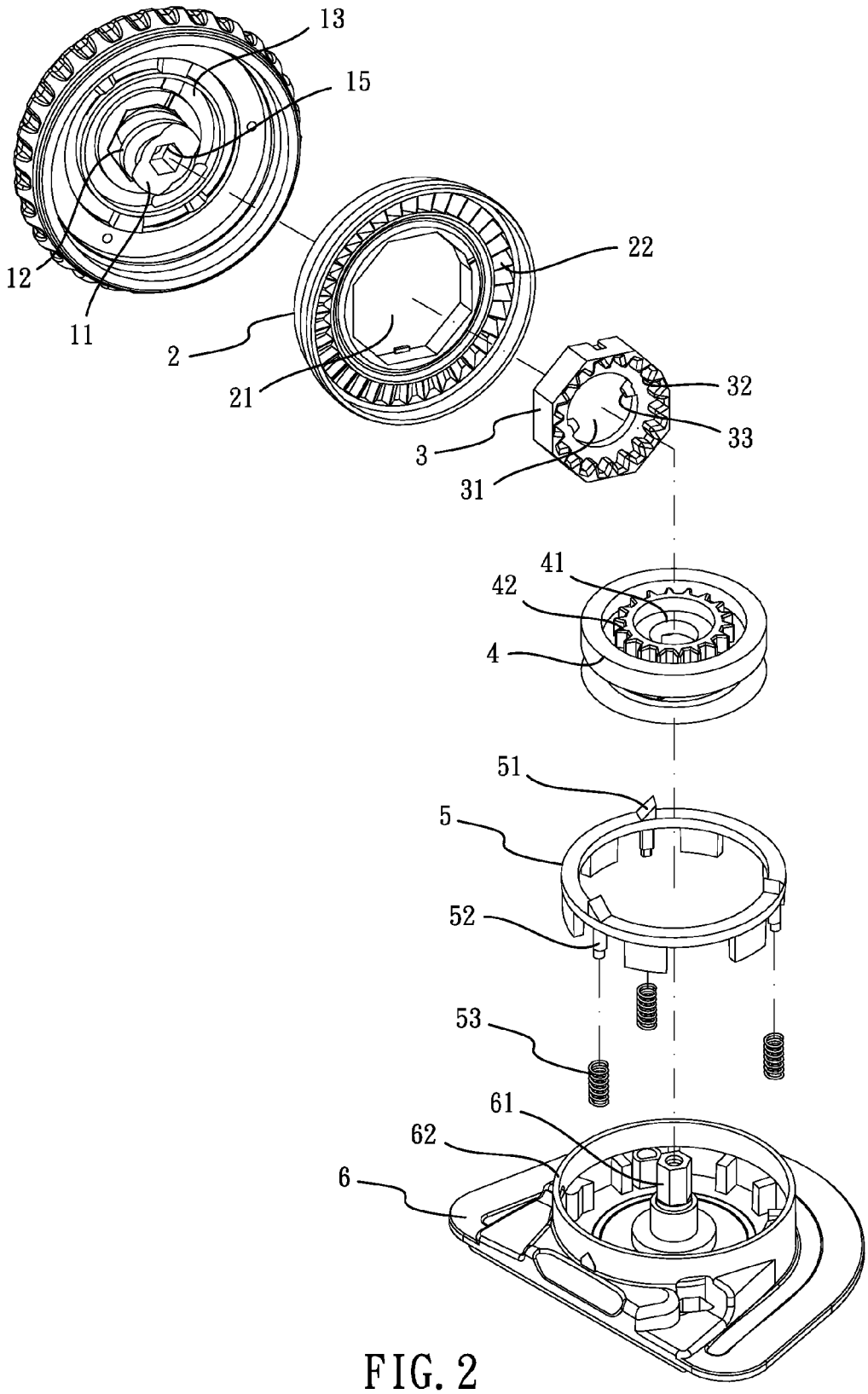
FIG. 2 is an exploded perspective view of the closure device in accordance with the present invention in another direction.
Figure 3:
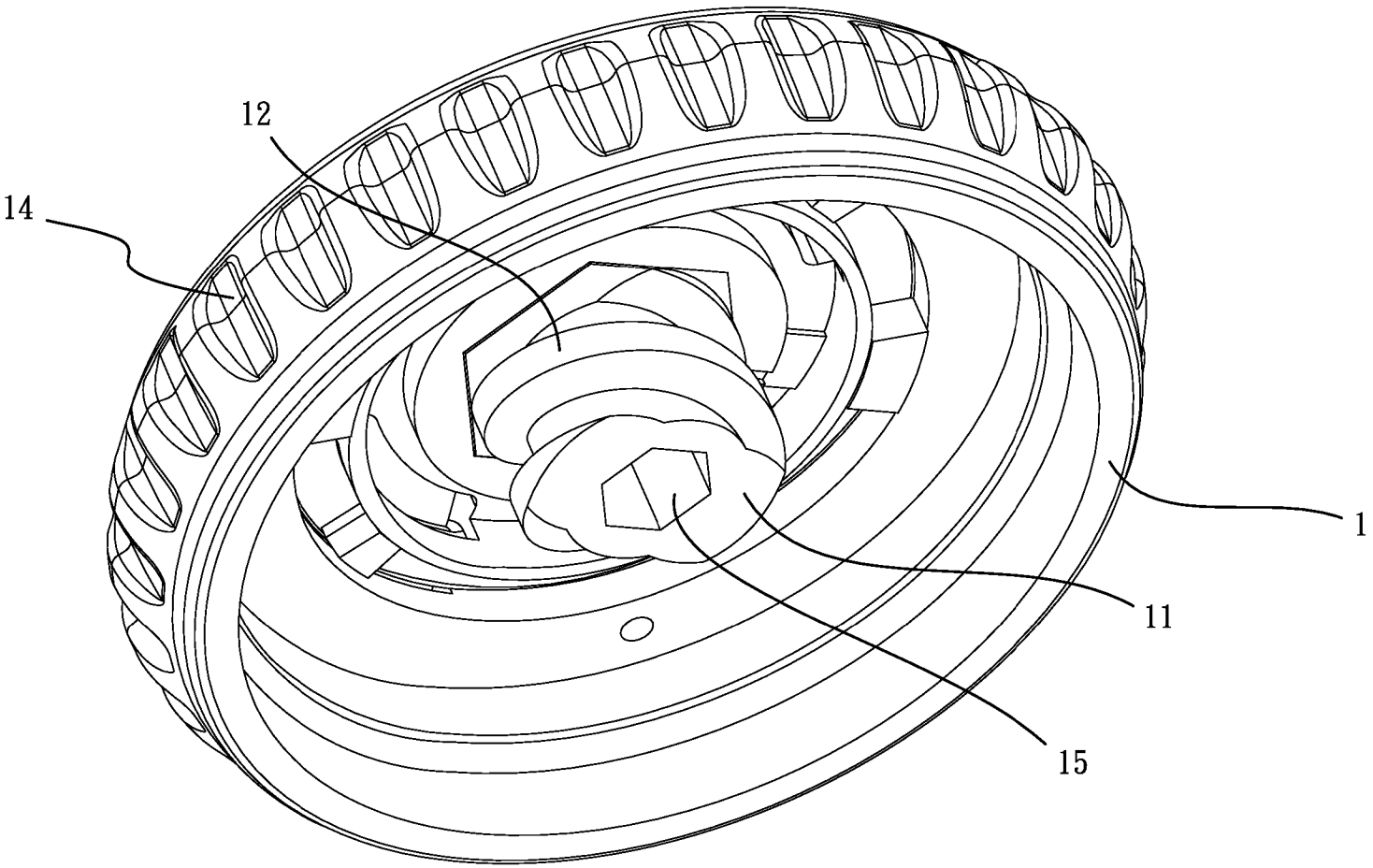
FIG. 3 is an enlarged perspective view of a knob of the closure device in accordance with the present invention in another direction.
Figure 4:
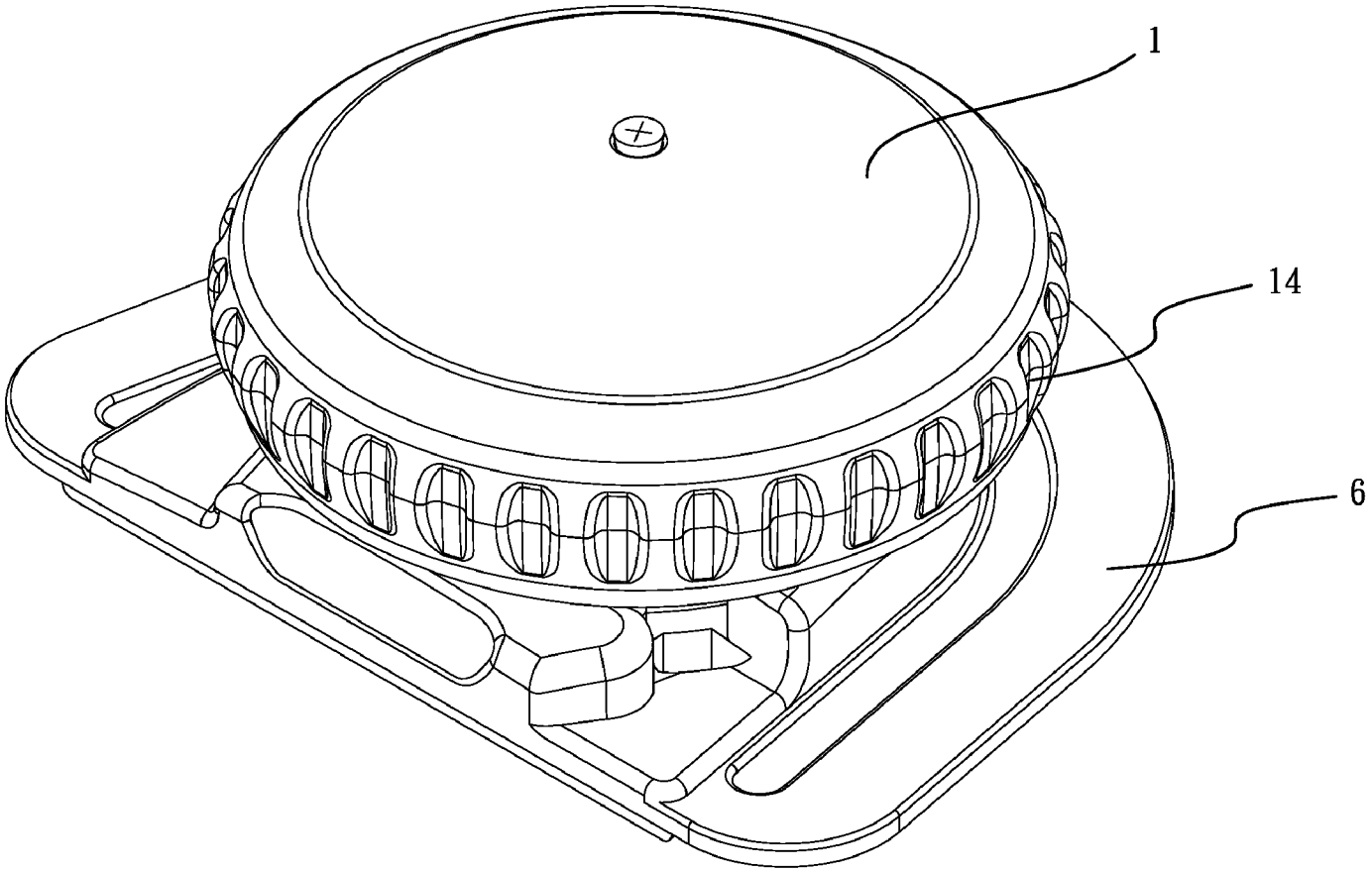
FIG. 4 is an assembled perspective view of the closure device in accordance with the present invention in another direction.

Referring to the drawings and initially to FIGS. 1-4, a closure device in accordance with the present invention comprises a knob 1.

The knob 1 has a spindle 11 extending from a bottom thereof The spindle 11 has a thread 12 positioned therearound. The knob 1 has at least one curved groove 13 defined in the bottom thereof and located adjacent to the spindle 11. In the preferred embodiment of the present invention, two curved grooves 13 symmetrically defined on the bottom of the knob 1. The spindle 11 has a spindle hole 15 axially defined therein. The knob 1 has a plurality of the notches 14 defined on an outer periphery thereof for increasing friction.

A ratchet member 2 is mounted on the bottom of the knob 1. The ratchet member 2 has at least one rib 23 disposed thereon for being correspondingly received in the at least one curved groove 13. In the preferred embodiment of the present invention, the ratchet member 2 has two ribs 23 disposed thereon. The ratchet member 2 has a cavity 21 defined therein and passing therethrough. The cavity 21 has a polygonal shape. The ratchet member 2 has a series of ratchet teeth 22 formed on a bottom thereof and located around the cavity 21. The cavity 21 has at least one tenon 24 extending from an inner periphery thereof.

An engaging member 3 is movably received in the cavity 21. The engaging member 3 has a polygonal shape corresponding to that of the cavity 21 such that the engaging member 3 is restricted in the cavity 21. The engaging member 3 has at least one mortise 34 defined in an outer periphery thereof for restricting the engaging member 3 in the cavity 21 and preventing the engaging member 3 rotating relative to the cavity 21. The engaging member 3 has an engaging hole 31 defined therein and passing therethrough. The engaging hole 3 has at least one protrusion 33 inwardly extending from an inner periphery thereof for engaging with the thread 12 of the spindle 11. The engaging member 3 has an engaging gear 32 formed on a bottom thereof and annularly located around the engaging hole 31. In the preferred embodiment of the present invention, the engaging gear 32 is an inner gear.

A spool 4 is mounted on a bottom of the engaging member 3. The spool 4 has a spool gear 42 annularly formed on a top thereof for corresponding to the engaging gear 3. In the preferred embodiment of the present invention, the spool gear 42 is an outer gear. The spool gear 42 has a spool hole 41 defined therein and passing therethrough. In the preferred embodiment, the invention is utilized on a shoe and the spool 4 has an annular groove (not numbered) defined on an outer periphery thereof for adapting to receive a lace.

A stopper 5 is mounted around the spool 4. The stopper 4 has at least one tooth 51 formed on a top thereof for unidirectionally engaging with the ratchet teeth 22 of the ratchet member 2. The stopper 5 has at least one rod 52 downwardly extending from a bottom thereof Each of the at least one rod 52 has a spring 53 sleeved thereon. The stopper 5 is able sink downwardly due to the compression of the spring 53.

A base 6 has a pivot 61 extending therefrom. The pivot 61 is freely rotatable. The pivot 61 passes through the spool hole 41, the engaging hole 31, and the cavity 21 and fixed in the spindle hole 15 in the knob 1 such that the spindle 11 and the pivot 61 are simultaneously rotated. The base 6 has a skirt 62 upwardly extending therefrom. The spool 4, the stopper 5, and the engaging member 3 are received in the skirt 62. The knob 1 and the ratchet member 2 are mounted above the skirt 62.

Figure 5:
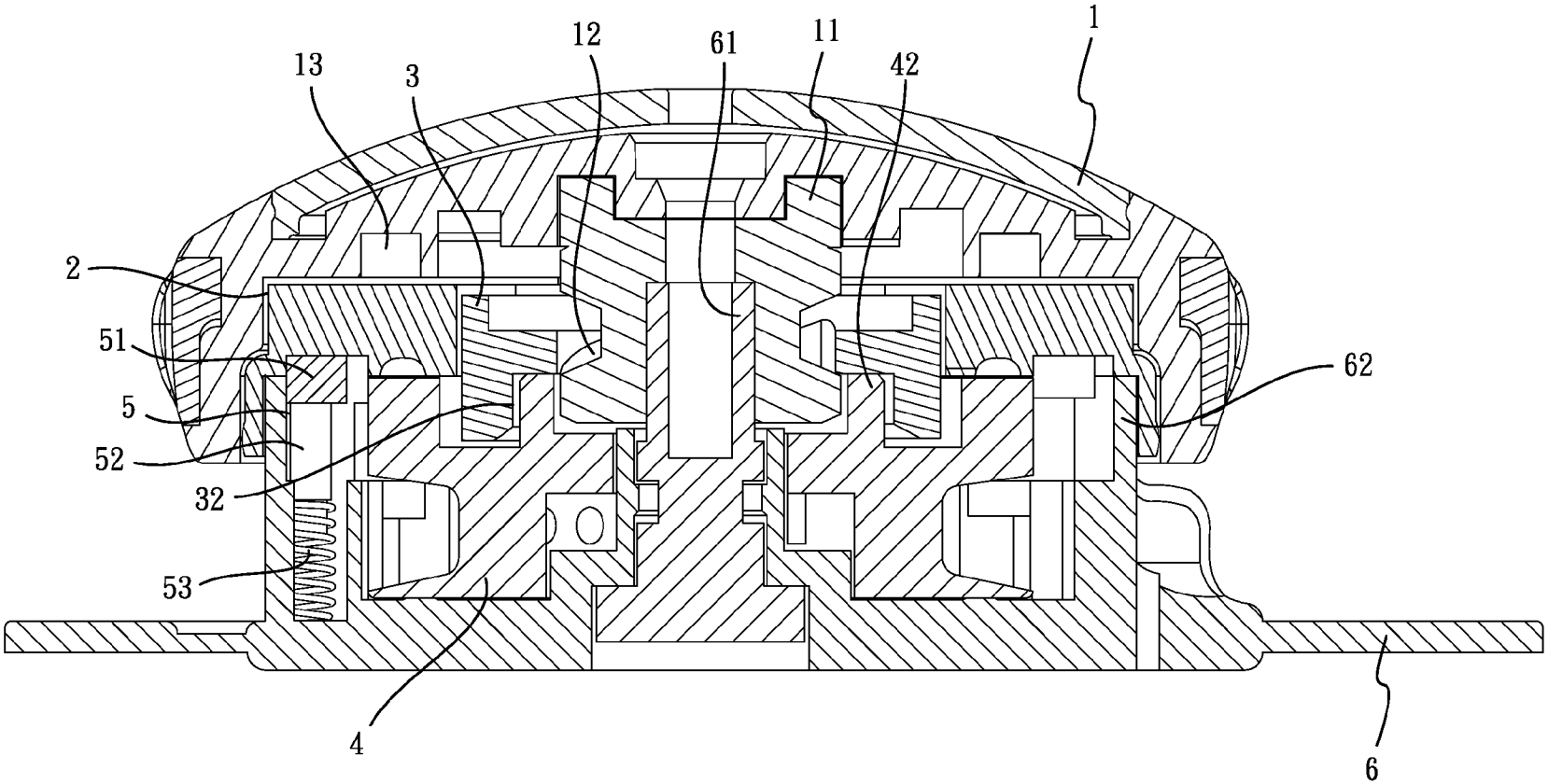
FIGS. 5-6 are operational views of the closure device in accordance with the present invention in another direction.

Referring to FIG. 5, when the knob 1 is rotated toward a first direction, the knob 1 is rotated relative the ratchet member 2 and the engaging member 3. The at least one rib 23 is moved along the first direction and abutted against an inner periphery of the at least one curved groove 13 such that the ratchet member 2 is driven by knob 1 and simultaneously rotated with knob 1. The engaging member 3 is engaged by the thread of the spindle 12 and restricted in the cavity 21 such that the engaging member 3 is downwardly moved relative the ratchet member 2. The engaging gear 32 is engaged with the spool gear 42 of the spool 4, such that the knob 1 simultaneously drives the ratchet member 2, the engaging member 3, and the spool 4 for adapting to wind the lace.

In the meanwhile, when the knob 1 with ratchet member 2 are rotated toward the first direction, the ratchet teeth 22 of the ratchet member 2 engages with the at least one tooth 51 of the stopper 5. The stopper 5 is downwardly moved such that the at least one tooth 51 is ratchetably engaged with the ratchet teeth 22 and the ratchet member 2 is only ratchetably rotated toward the first direction.

Figure 6:
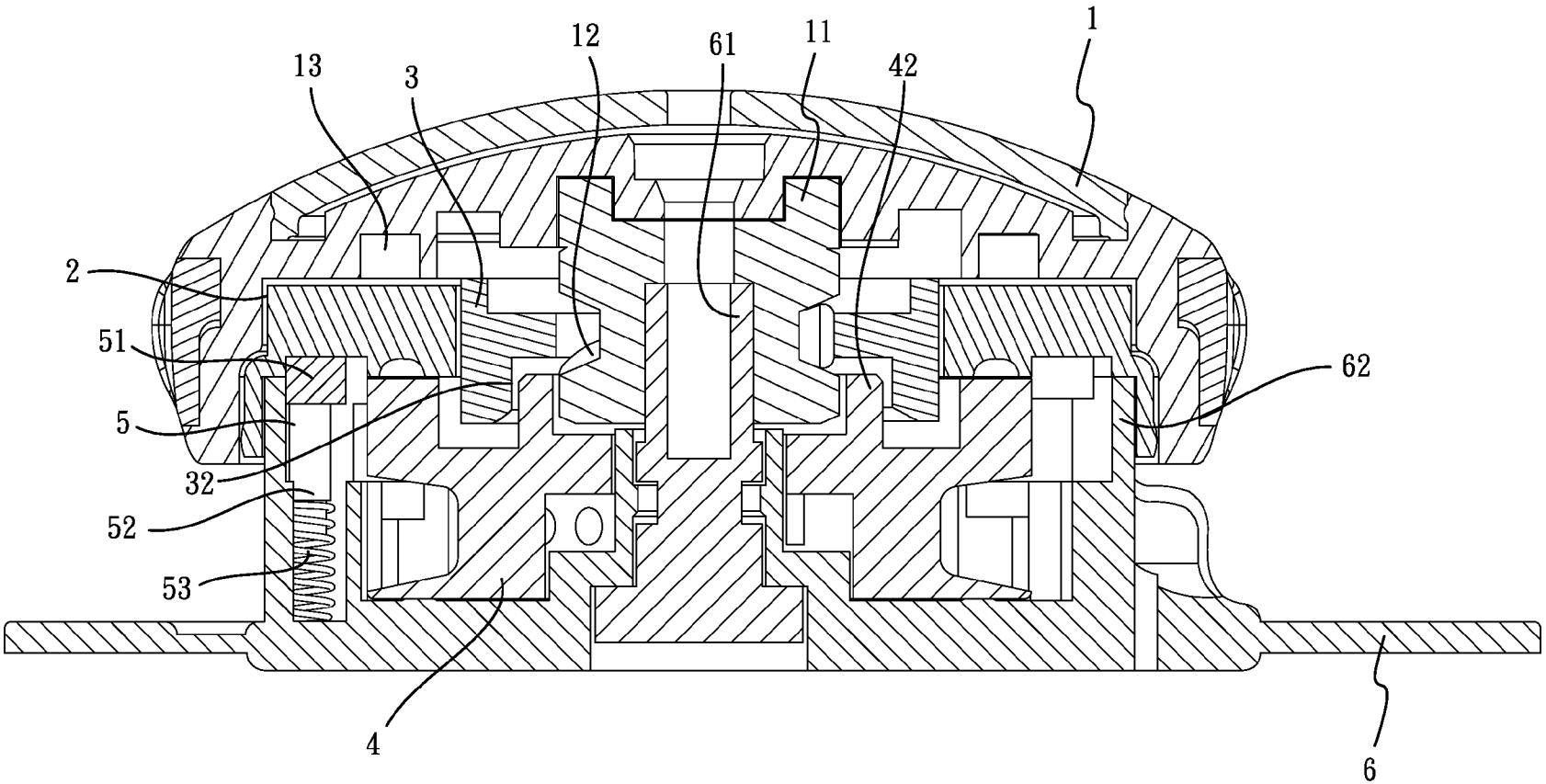

Referring to FIG. 6, when the knob 1 is rotated toward a second direction which is opposite to the first direction, the engaging member 2 is not able to rotate toward the second direction such that the knob 1 is idle-rotated relative to the engaging member 2 along the second direction. The engaging member 2 is engaged by the thread 12 of the spindle 11 and restricted in the cavity 21 such that the engaging member 3 is upwardly moved relative the ratchet member 2 for disengaging from the spool 4. The spool 4 is released and is free to rotate for adapting to unwind the lace.

Figure 7:
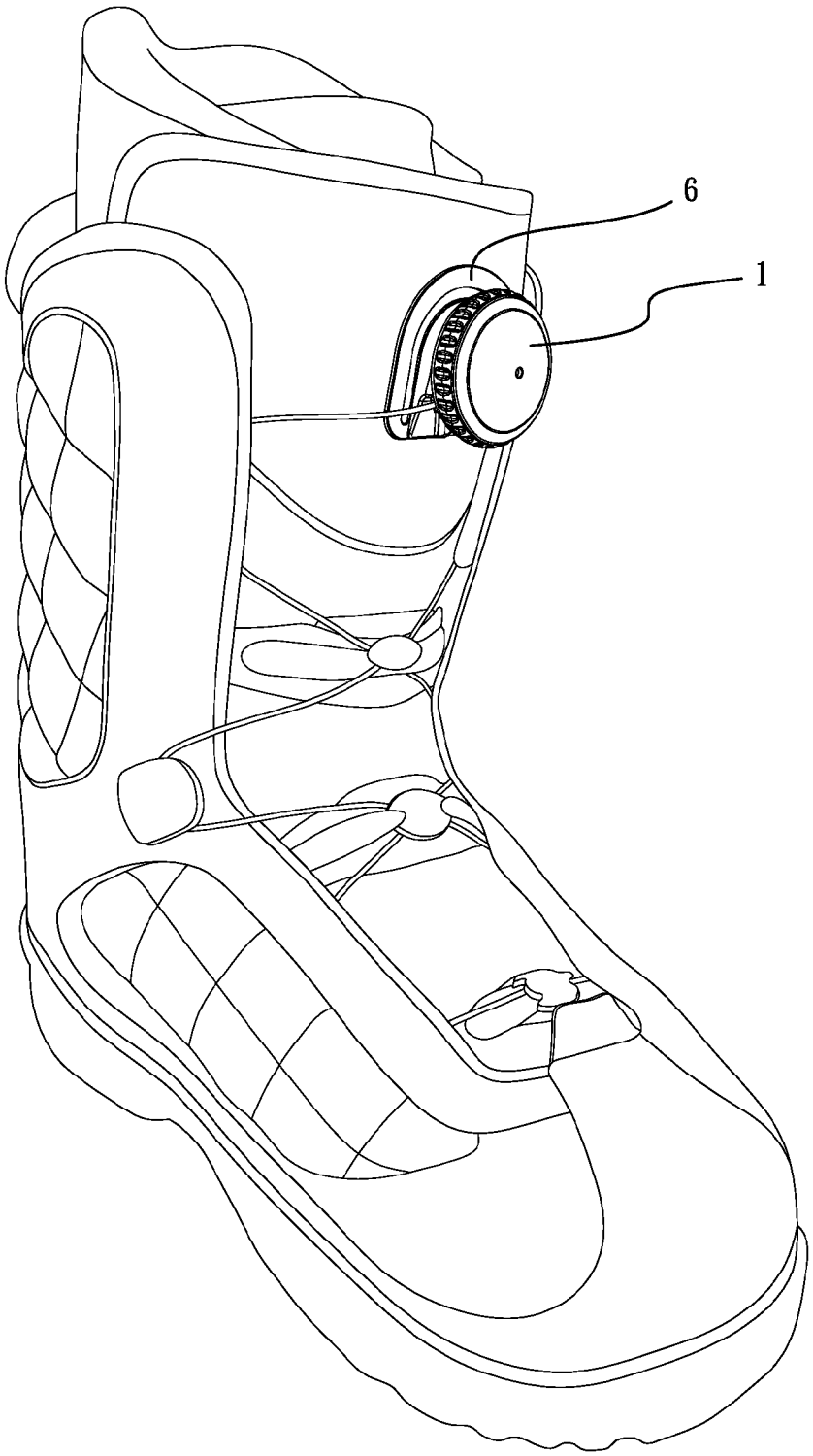
FIG. 7 is perspective view for showing the closure device in accordance with the present invention utilizing on a snow boot.

Referring to FIG. 7, the closure device of present invention is adapted to utilize on a special lace of a shoe, such as snow boot or bicycle shoe for attending a fast releasing/tightening effect.

Although the invention has been explained in relation to its preferred embodiment, it is to be understood that many other possible modifications and variations can be made without departing from the spirit and scope of the invention as hereinafter claimed.

What is claimed is:

1. A closure device comprising:

a knob, the knob having a spindle extending from a bottom thereof, the spindle having a thread positioned therearound, the knob having at least one curved groove defined in the bottom thereof and located adjacent to the spindle;

a ratchet member mounted on the bottom of the knob, the ratchet member having at least one rib disposed thereon for being correspondingly received in the at least one curved groove, the ratchet member having a cavity defined therein and passing therethrough, the ratchet member having a series of ratchet teeth formed on a bottom thereof and located around the cavity;

an engaging member movably received in the cavity, the engaging member having an engaging hole defined therein and passing therethrough, the engaging hole having at least one protrusion inwardly extending from an inner periphery thereof for engaging with the thread of the spindle, the engaging member having an engaging gear formed on a bottom thereof and annularly located around the engaging hole;

a spool mounted on a bottom of the engaging member, the spool having a spool gear annularly formed on a top thereof for corresponding to the engaging gear, the spool gear having a spool hole defined therein and passing therethrough;

a stopper mounted around the spool, the stopper having at least one tooth formed on a top thereof for unidirectionally engaging with the ratchet teeth of the ratchet member; and a base, the base having a pivot extending therefrom and passing through the spool hole, the engaging hole, and the cavity and fixed on the knob; the stopper, the spool, the engaging member, and the ratchet member received in the base;

wherein, when the knob is rotated toward a first direction, the knob rotated relative to the ratchet member and the engaging member, the at least one rib moved along the first direction and abutted against an inner periphery of the at least one curved groove such that the ratchet member is driven by the knob and simultaneously rotated with the knob, the engaging member being engaged by the thread of the spindle and restricted in the cavity such that the engaging member is downwardly moved relative to the ratchet member, the engaging gear engaged with the spool gear of the spool, such that the knob simultaneously drives the ratchet member, the engaging member, and the spool for adapting to wind a lace;

when the knob with the ratchet member are rotated toward the first direction, the ratchet teeth of the ratchet member engaging with the at least one tooth of the stopper, the stopper downwardly moved such that the at least one tooth is ratchetably engaged with the ratchet teeth and the ratchet member is able to ratchetably rotate toward the first direction;

when the knob is rotated toward a second direction which is opposite to the first direction, the engaging member being not able to rotate toward the second direction such that the knob is rotated relative to the engaging member along the second direction, the engaging member being engaged by the thread of the spindle and restricted in the cavity such that the engaging member is upwardly moved relative to the ratchet member for disengaging from the spool, the spool released and being free to rotate.

2. The closure device as claimed in claim 1, wherein the cavity has a polygonal shape, the engaging member having a polygonal shape corresponding to that of the cavity such that the engaging member is restricted in the cavity.

3. The closure device as claimed in claim 1, wherein the cavity has at least one tenon extending from an inner periphery thereof, the engaging member having at least one mortise defined in an outer periphery thereof for restricting the engaging member in the cavity and preventing the engaging member rotating relative to the cavity.

4. The closure device as claimed in claim 1, wherein the stopper has at least one rod downwardly extending from a bottom thereof, each of the at least one rod having a spring sleeved thereon and mounted on the base, the stopper being able to sink downwardly due to the compression of the spring.

5. The closure device as claimed in claim 1, wherein the base has a skirt upwardly extending therefrom, the spool and the engaging member received in the skirt, the knob and the ratchet member mounted above the skirt.

6. The closure device as claimed in claim 1, wherein the spindle having a spindle hole axially defined therein for receiving the pivot such that the spindle and the pivot are simultaneously rotated.

7. The closure device as claimed in claim 1, wherein the knob has a plurality of notches defined on an outer periphery thereof for increasing friction.

* * * * *